US008134822B2

(12) United States Patent
Ballantine et al.

(10) Patent No.: US 8,134,822 B2
(45) Date of Patent: Mar. 13, 2012

(54) REMOTE INITIATOR FOR THE REMOTE INITIATION OF EXPLOSIVE CHARGES

(75) Inventors: Roger Ballantine, Lower Hutt (NZ); Anthony Paul Hornbrook, Lower Hutt (NZ); Ian Moore, Lower Hutt (NZ); Tony Humphries, Lower Hutt (NZ)

(73) Assignee: Mas Zengrange (NZ) Ltd (NZ)

( * ) Notice: Subject to any disclaimer, the term of this patent is extended or adjusted under 35 U.S.C. 154(b) by 545 days.

(21) Appl. No.: 12/440,313

(22) PCT Filed: Sep. 20, 2006

(86) PCT No.: PCT/NZ2006/000242

§ 371 (c)(1),
(2), (4) Date: Mar. 6, 2009

(87) PCT Pub. No.: WO2008/035987

PCT Pub. Date: Mar. 27, 2008

(65) Prior Publication Data

US 2010/0170411 A1 Jul. 8, 2010

(30) Foreign Application Priority Data

Sep. 19, 2006 (NZ) ..... 549967

(51) Int. Cl.
*F23Q 21/00* (2006.01)
*F42D 1/04* (2006.01)
*F42C 9/00* (2006.01)

(52) U.S. Cl. ..... 361/248; 102/206; 102/200; 102/276

(58) Field of Classification Search ..... 361/248; 102/206, 200, 276

See application file for complete search history.

(56) References Cited

U.S. PATENT DOCUMENTS

| | | | | |
|---|---|---|---|---|
| 3,780,654 | A | 12/1973 | Shimizu et al. | |
| 4,246,845 | A | 1/1981 | Winton et al. | |
| 4,576,093 | A | 3/1986 | Snyder | |
| 4,622,667 | A * | 11/1986 | Yount | 701/3 |
| 4,884,506 | A | 12/1989 | Guerreri | |
| 5,550,736 | A * | 8/1996 | Hay et al. | 701/3 |

(Continued)

FOREIGN PATENT DOCUMENTS

JP 2000145273 A 6/2000

(Continued)

*Primary Examiner* — Jared Fureman
*Assistant Examiner* — Scott Bauer
(74) *Attorney, Agent, or Firm* — Brooks Kushman P.C.

(57) ABSTRACT

A remote initiator for the remote initiation of explosive charges. The remote initiator having: (i) a transmitter with means for generating and transmitting a coded signal and input means for inputting operational commands into the transmitter for generating the coded signal, (ii) at least one receiver adapted to be connected with the explosive charges, the receiver having means for receiving the coded signal from the transmitter and input means for inputting operational commands into the receiver for generating an output signal for the remote initiation of explosive charges upon receipt of a valid transmitted coded signal, (iii) a power source for each of the transmitter and receiver, and dual processing means that are independent of each other are adapted to provide independent control of a firing circuit and adapted to synchronise with each processing means before initiation can occur so as to enhance safety and reliability of the transmitter and receiver and the initiation of the remote initiator.

41 Claims, 8 Drawing Sheets

U.S. PATENT DOCUMENTS

| | | | | |
|---|---|---|---|---|
| 6,718,881 | B2 | 4/2004 | Rauscher, Jr. | |
| 6,860,206 | B1 * | 3/2005 | Rudakevych et al. | 102/206 |
| 7,100,511 | B2 | 9/2006 | Meyer et al. | |
| 7,493,859 | B2 * | 2/2009 | Russell | 102/361 |
| 2003/0192447 | A1 * | 10/2003 | Meyer et al. | 102/206 |
| 2005/0030695 | A1 | 2/2005 | Meyer et al. | |

FOREIGN PATENT DOCUMENTS

| | | | |
|---|---|---|---|
| WO | 9924776 | A1 | 5/1999 |
| WO | 2005071348 | A1 | 8/2005 |

* cited by examiner

REMOTE INITIATOR FOR THE REMOTE INITIATION OF EXPLOSIVE CHARGES

TECHNICAL FIELD OF THE INVENTION

The invention relates to a remote initiator for the remote initiation (RI) of explosive charges.

BACKGROUND OF INVENTION

There is a generalized requirement for the military, other related defense agencies and other users of explosives to safely detonate explosives. Safely in this context means: safely separated in distance, safely separated in time and security of initiation. Explosives are initiated by electrical circuit cable or other non-electrical 'cable', but if the cable must be run for a great distance (from hundreds of meters up to several km) or there are multiple circuits again entailing substantial cable lengths, remote initiation by radio signal becomes highly desirable. Also in cases of electrical initiation, long cable lengths allow greater susceptibly to initiation of the charge via electro-magnetic induction onto the cable (radio signals or lightning strikes).

Security of initiation requires that the explosive must not be initiated falsely, either because of erroneously decoded signals or deliberately spoofed signals. Also to ensure the extremely high level security required, the equipment must be protected against the possibility of the failure of microprocessors and the program code. The firing circuits must also be designed and analyzed to a very high standard to ensure that component failure will not result in the firing voltage being incorrectly applied to the explosive circuit.

The remote initiation equipment needs to be as small in volume and as light weight as possible. The radio transmission system needs to operate over a good distance; line-of-sight to 25 km, ground to ground, in a rural environment of 10 km and 3 km in an urban environment. The equipment needs to be very robust, being carried in an environment that includes; temperatures from −40° C. to +60° C., water depths of 20 meters and in aircraft flying to 30,000 ft.

Another desirable feature would be to include a timed initiation function that would still allow remote initiation over-ride.

Operation from ordinarily available disposable batteries is very desirable. The receiving unit needs be able to be deployed for up to 15 days and still initiate the explosive at the end of a 300 meter cable.

The operation of the equipment must be safe, simple, and easy to train soldiers in its use. The operator must have time to withdraw from the scene of operations before the equipment becomes active. The signalling protocol of equipment must allow for a good deal of flexibility of deployed receiving equipment numbers, combinations of simultaneous and separate detonations to cover a large variation of operational requirements.

Current Remote Initiation Equipment

Current RI equipment is bulky and heavy with weights around 1.5 kg and volumes around 1500 cubic cm. This weight and volume is driven by the need to increase power endurance which leads to existing cumbersome battery solutions. Further the frequency bands may not be well chosen to achieve the required distances. This can also lead to increased power demand through the selected transmitter power level.

Some current equipments attempt to increase distance by providing retransmission units, i.e. a receiver captures the signal halfway down range and couples it to another transmitter that repeats it onward to the ultimate receiver (possibly multiple times). However, this greatly increases the system complexity, set up times and weight of the total system (at least 4 bulky items with associated batteries).

The reliability of a single microprocessor can be suspect, as either a simple failure of the electronic machine or an untested software path could result in the triggering of the firing circuit. The safest assumption to make about a microprocessor and its program is that it could arbitrarily decide to initiate a firing event. To guard against such an event, a secondary processor with its own independent control of the firing circuit can be incorporated.

No inexpensive, safe expendable remote initiation expendable receiver is known to be available within current product ranges.

Disadvantages of Existing Remote Initiators

Safety: It is not known of any prior equipment with the safety design of the invention hereinafter described.

Volume and Weight: The volume and weight of known prior equipment is at least three times greater than the invention.

Power Endurance: The power endurance of known prior equipment is less than or equal to the endurance of the invention. While the invention does not use special to type batteries rather simple primary cells available from most stores.

Ease of Use and Training: None of the existing remote initiators provide simplicity of use. A considerable amount of training and experience is required in any but the most simple of deployments.

Operational Radio Range: Radio ranges of current systems fall short of the ranges desired by the user community.

OBJECT OF THE INVENTION

It is an object of the invention to provide a remote initiator for the remote initiation of explosive charges that ameliorates some of the disadvantages and limitations of the known art or at least provide the public with a useful choice.

SUMMARY OF INVENTION

In a first aspect the invention resides in a remote initiator for the remote initiation of explosive charges, wherein the remote initiator includes:

(i) a transmitter having means for generating and transmitting a coded signal and input means for inputting operational commands into the transmitter for generating the coded signal, (ii) at least one receiver connected with the explosive charges, the receiver having means for receiving the coded signal from the transmitter and input means for inputting operational commands into the receiver for generating an output signal for the remote initiation of explosive charges upon receipt of a valid transmitted coded signal, (iii) a power source for each of the transmitter and receiver, and (iv) dual processing means that are independent of each other are adapted to provide independent control of a firing circuit and adapted to synchronize with each processing means before initiation can occur so as to enhance safety and reliability of the transmitter and receiver and the initiation of the remote initiator.

In a second aspect the invention resides in a remote initiator for the remote initiation of explosive charges, the remote initiator includes:

(i) a transmitter having means for generating and transmitting a coded signal and input means for inputting operational commands into the transmitter for generating the coded signal, (ii) at least one receiver connected with the explosive charges, the receiver having means for receiving the coded signal from the transmitter and input means for inputting operational commands into the receiver for generating an output signal for the remote initiation of explosive charges upon receipt of a valid transmitted coded signal, (iii) a power source for each of the transmitter and receiver, and (iv) dual processing means that are independent, of each other are adapted to provide independent control of a firing circuit and adapted to synchronize with each processing means before initiation can occur so as to enhance safety and reliability of the transmitter and receiver and the initiation of the remote initiator, wherein the transmitter and receiver share and store a common signalling code that binds both the transmitter and receiver to a group and the receiver will only respond to a transmitted coded signal that matches all parts of the common signalling code stored in the receiver.

In a third aspect the invention resides in a remote initiating system for the remote initiation of explosive charges, the remote initiating system includes a remote initiator including:

(i) a transmitter having means for generating and transmitting a coded signal and input means for inputting operational commands into the transmitter for generating the coded signal, (ii) at least one receiver connected with the explosive charges, the receiver having means for receiving the coded signal from the transmitter and input means for inputting operational commands into the receiver for generating an output signal for the remote initiation of explosive charges upon receipt of a valid transmitted coded signal in communication with the receiver, (iii) a power source for each of the transmitter and receiver, and (iv) dual processing means that are independent of each other are adapted to provide independent control of a firing circuit and adapted to synchronize with each processing means before initiation can occur so as to enhance safety and reliability of the transmitter and receiver and the initiation of the remote initiator, wherein the transmitter and receiver share and store a common signalling code that binds both the transmitter and receiver to a group and the receiver will only respond to a transmitted coded signal that matches all parts of the common signalling code stored in the receiver.

Preferably, each processing means are of a different type relative to other.

Preferably, each processing means is a computerized processing means.

Preferably, the processing means is a microprocessor.

Preferably, each processing means in has a clock wherein the times of each clock must be synchronized with each other before initiation of the remote initiator can occur.

Preferably, the transmitter includes the dual processing means.

Preferably, the receiver includes the dual processing means.

Preferably, both the transmitter and receiver include separate dual processing means.

Preferably, each microprocessor is a differing type relative to other to ensure no common failings in each processor.

Preferably, the software for each microprocessor is independently written.

Preferably, the transmitter and receivers share a common signal code, wherein the signal code includes:

(i) a USER code adapted to allow remote initiator to be initiated by the designated users, (ii) a GROUP code adapted to allow users of a group to use the initiator, and (iii) a CIRCUIT code adapted to allow for multiple and separate charges to fielded and initiated separately by the remote initiator.

Preferably, there is a plurality of receivers.

Preferably, the transmitter and receivers share a common signal code, wherein the signal code includes:

(i) a USER code adapted to allow remote initiator to be initiated by the designated users, (ii) a GROUP code adapted to allow users of a group to use the initiator, and (iii) a CIRCUIT code adapted to allow for multiple and separate charges to fielded and initiated separately by the remote initiator.

Preferably, each of the transmitter and receiver have built in self tests adapted to be activated at switch on.

Preferably, both the transmitter and receiver are adapted to operate and withstand environmental extremes.

Preferably, the transmitter and receiver are adapted to operate in saltwater to depth of 20 meters, operate in temperature range of −40° C. and +60° C.

Preferably, the receiver includes a timer initiation function adapted to allow detonation after a settable elapsed time delay.

Preferably, the timer initiation function is adapted to be overridden so as to still allow for remote firing and detonation.

Preferably, the receiver is adapted to be reusable.

Preferably, the receiver is adapted to be expendable.

Preferably, the transmitter is adapted to activate a receiver with a line of sight transmission within 25 kms Preferably, the transmitter is adapted to activate a receiver in an urban environment within 3 kms.

Preferably, the transmitter is adapted to activate a receiver in open terrain within 3-5 kms.

Preferably, the power source is a battery or batteries.

Preferably, the transmitter includes control buttons that are adapted to permit simultaneous two button operation is required for firing of the remoter initiator.

Preferably, the software for each microprocessor has strict coding practices including:

(i) use of pseudo 'high level' code (PDL) to define code structure before converting to assembler language, (ii) only one entry and exit point in sub-programs, (iii) strict control on use of registers to minimize accidental over-writes, (iv) use of a separate register bank for interrupt handling, (v) use of interrupts restricted to timing and data reception, (vi) avoidance of the use of dynamic memory management, (vii) avoidance of the use of floating point arithmetic. and (viii) protection of sensitive data by CRC checksums.

Preferably, the remote initiator is adapted to use either radio signals or time or both for the command detonation of the explosives.

Preferably, the receiver is adapted to only respond to the common signalling code received from the transmitter only if the transmitted common signalling code matches all parts of the receivers internal code.

Preferably, there is a plurality of receivers, each adapted to receive and process a coded signal from the transmitter and initiate an output signal for the remote initiation of explosive charges in communication with the receivers.

In other aspects herein described

BRIEF DESCRIPTION

The invention will now be described, by way of example only, by reference to the accompanying drawings:

FIG. 1 is a front perspective view of a transmitter in accordance with a first preferred embodiment of the invention.

FIG. 2 is a front perspective view of a receiver in accordance with a first preferred embodiment of the invention.

FIG. 2A is a back perspective view of the receiver shown in FIG. 2.

FIG. 3 is a front perspective view of a receiver in accordance with a second preferred embodiment of the invention.

FIG. 4 is a flow chart showing the steps for configuring a receiver circuit code in accordance with a first preferred embodiment of the invention.

FIGS. 5A & 5B is a flow chart showing the steps for deploying the receiver to initiate detonation in accordance with a first preferred embodiment of the invention.

FIG. 6 is a flow chart showing the steps for firing a circuit in accordance with a first preferred embodiment of the invention.

DESCRIPTION OF DRAWINGS

The following description will describe the invention in relation to preferred embodiments of the invention, namely a remote initiator for the remote initiation of explosive charges. The invention is in no way limited to these preferred embodiments as they are purely to exemplify the invention only and that possible variations and modifications would be readily apparent without departing from the scope of the invention.

The remote initiator of the invention includes a transmitter, one or more main receivers with some minor accessories. Transmitters and receivers share a common signalling code that binds the units into a GROUP. The common signalling code includes code parts that are: a USER code, a GROUP code and a CIRCUIT code. A receiver will only respond to a signal that matches all parts of its internal code (USER/GROUP/CIRCUIT). The USER code ensures that equipments supplied to separate military units cannot be initiated by some other military unit, i.e. a different country. The GROUP code allows for different elements of a common military force to use the initiator without triggering equipments deployed by other parts of the same force. The GROUP code is set in the transmitter and receivers at the time of manufacture or during high level maintenance.

Figure 1:
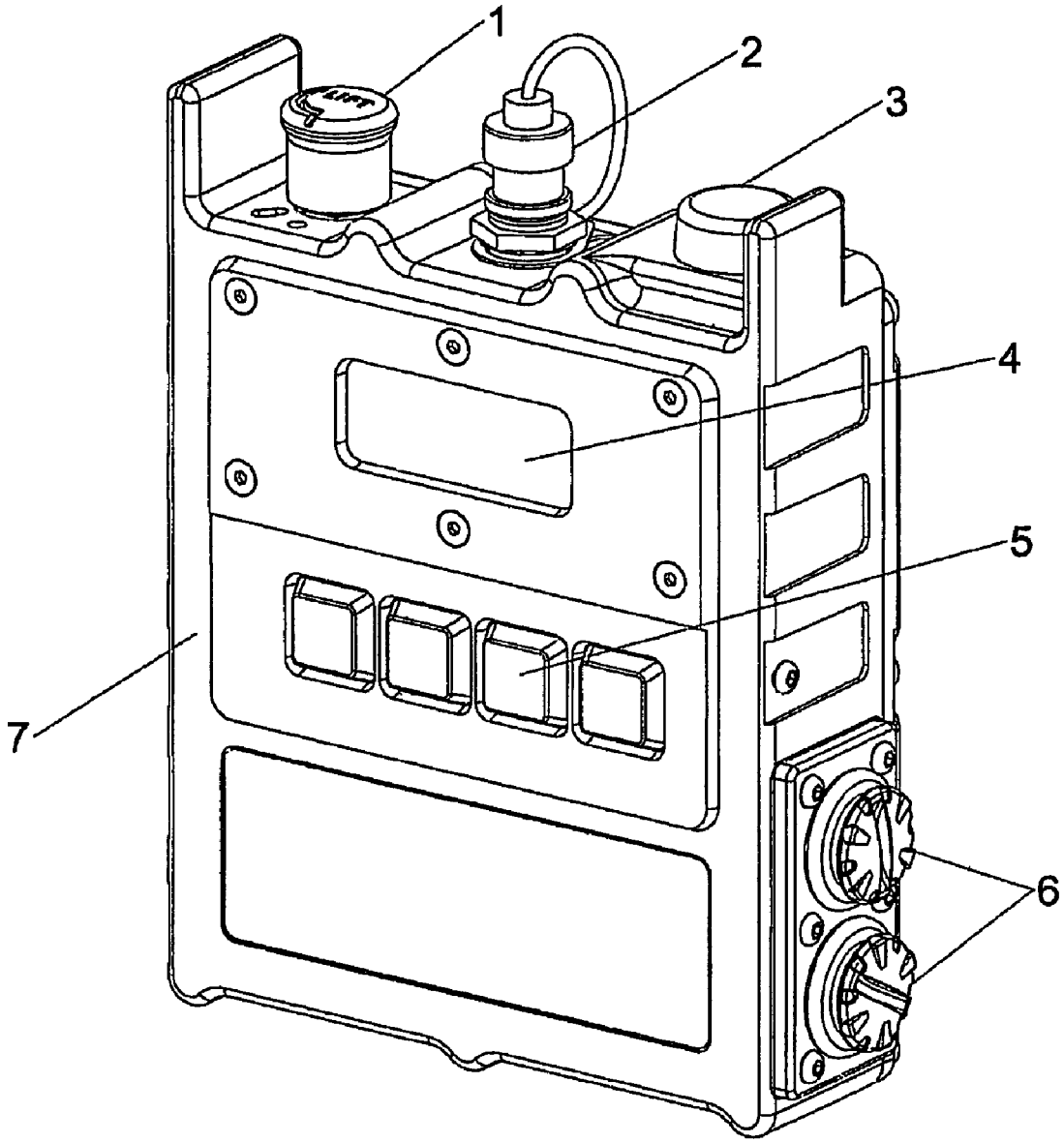

The CIRCUIT code allows for multiple and separate charges to be fielded and initiated separately. The CIRCUIT code of a receiver can be configured (set) by the use of a transmitter low power transmission. This allows receivers to assume a mixture of either individual or common CIRCUIT codes, i.e. either individual initiated detonations or simultaneous detonations.

Additionally, an expendable receiver can be configured by the same low powered transmitter transmission to assume the GROUP code of the transmitter, thus expendable receivers can be bonded to a non-expendable Group. This mechanism allows expendable receivers to be replaced within a Group.

The remote initiator can consist of a minimum group of one transmitter and one receiver.

A built in self-test function is performed on both transmitters and receivers at switch on. Further automatic tests are performed on the execution of various functions, e.g. battery level, charging voltage etc. Test failures are displayed on the LCD display as individual error codes and the equipment is put into a safe state. The signal strength of transmission to receivers can be performed and observed at the receivers by the deployment personnel. The transmitter and receiver build standard provides operational capabilities in extreme environments; including saltwater to a depth of 20 meters, temperature range of −40° C. and +60° C., carriage in un-pressurized aircraft to 30,000 ft.

A timer initiation function is included that permits receivers to initiate the detonation after a settable elapsed time delay. The receiver, while in an armed timer initiation state may still be fired by a remote radio command. A radio command to cancel the timer initiation function can also be issued. The receiver remains receptive to remote initiation commands after a cancellation of the timer initiation function.

To guard against unwarranted triggering of the firing circuit, the remote initiator includes two microprocessors, a primary processor and secondary processor, whereby each processor is provided with its own independent control of the firing circuit. Further the program for such the secondary processor is preferably written by an independent software team to that used for the software of the primary processor. The likelihood of two such independent processors deciding to initiate a firing event together is astronomically remote.

The remote initiators design and its implementation have had particular attention paid to its safety:

- The circuitry subjected to Fault Tree Analysis (FTA) to ensure that no single component failure could result in an unsafe condition.
- The design includes two Microprocessors with separate control of the firing circuit.
- Each microprocessor is of a different type to ensure no common failings in each microprocessor.
- The programs for the microprocessors are written by independent software teams with different software writing tools.
- The circuitry is subjected to Failure Modes Effect and Criticality Analysis.

FIG. 1 shows the transmitter housed in a painted aluminium housing 7. The housing is sealed to be waterproof to a depth of 20 meters and to withstand an altitude of 30,000 ft. The transmitter has volume of approximately 768 $cm^3$.

The transmitter can generate coded signals and radio transmit them to any of the receivers: that have been set to have the same user and group codes. The receivers of the reusable type are pre-programmed at manufacture to have the codes set. Receivers of the expendable type are programmed with a radio signal from the transmitter to have the same user and group codes as the transmitter. Further each receiver has a circuit-code that the transmitter includes within the signal such that a receiver can be uniquely initiated by that circuit code.

The transmitter can actuate a receiver with a line-of-sight transmission within 25 km. The antenna is either of the quarter-wave or a half-wave monopole. The transmitter is powered by four standard AA Alkaline cells in two battery tube holders 6.

Figure 6:
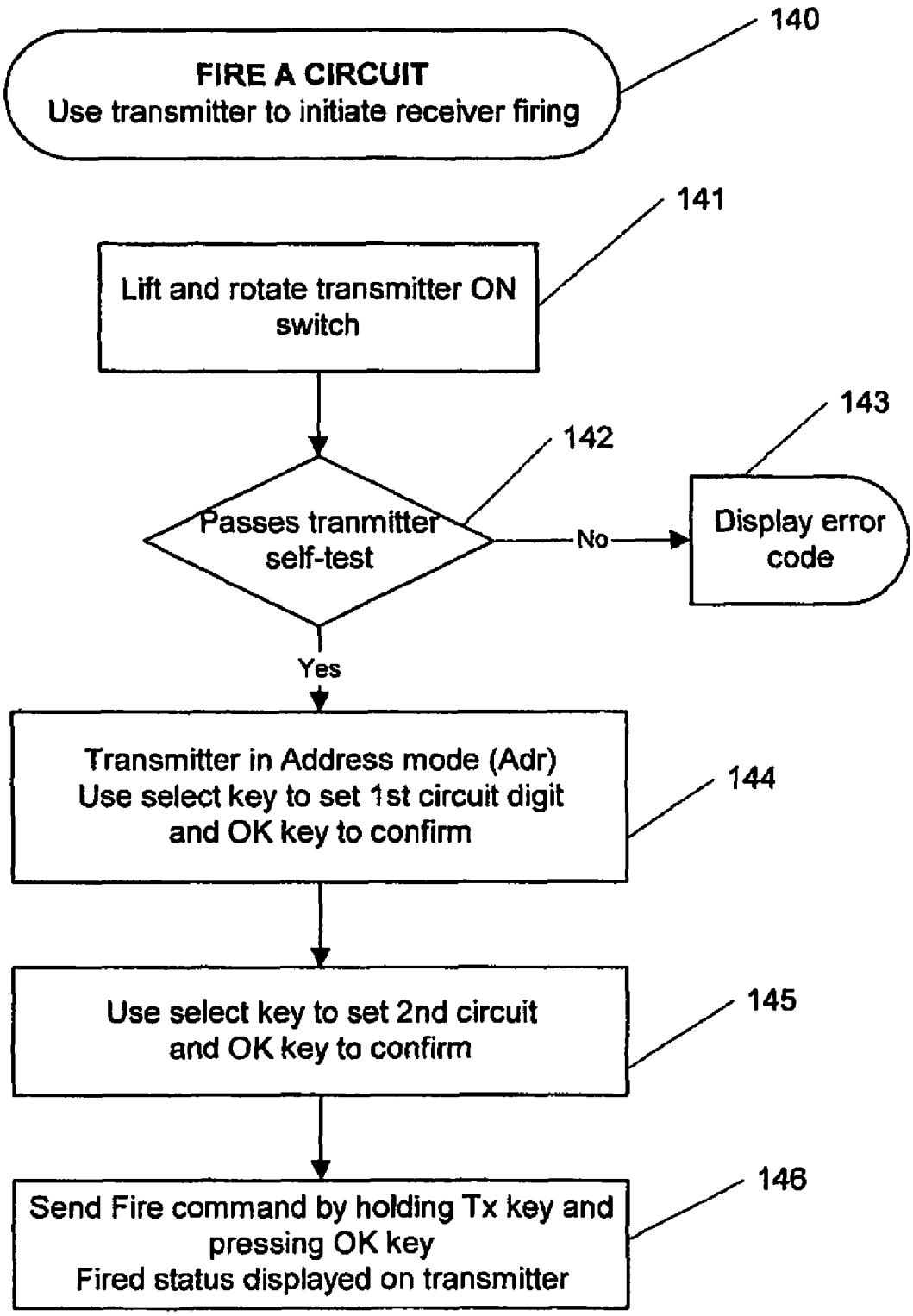

As shown in FIG. 1, the antenna is connected to the BNC connector 2 shown with a protective cover. The power is enabled by lifting and turning the power switch 1. The display 4 provides for the selection of transmitter functions and reports operating status. The keypad 5 provides for the selection of operating functions in a selection tree structure and the activation of selected functions. FIG. 6 shows the transmitter operation of sending a signal to cause a particular receiver to fire a designated circuit. The Fire button 3 and the keypad action key must be pressed together radiate a Fire signal.

Figure 4:
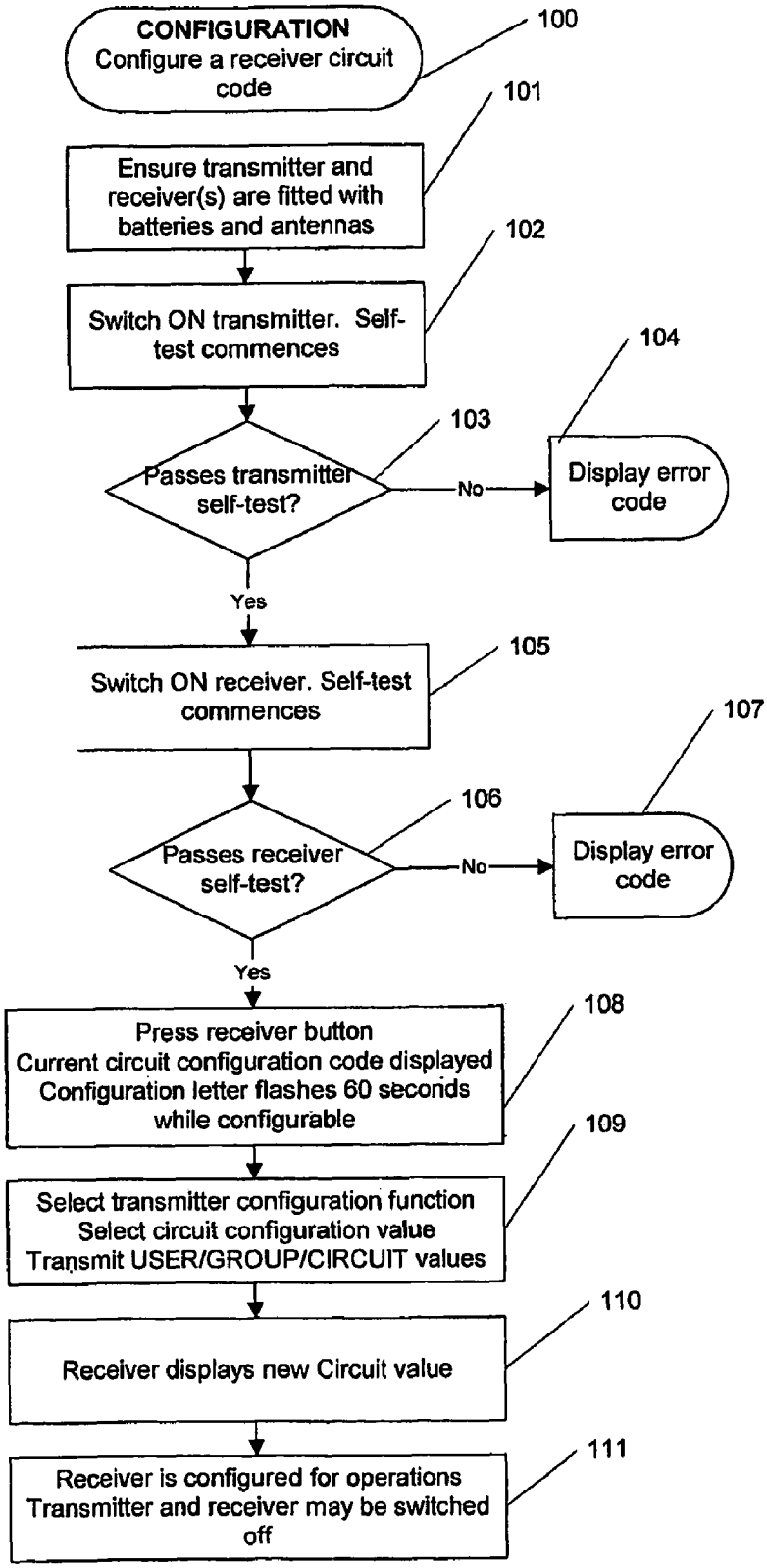

A further function of the transmitter FIG. 4 radiates a low power configuration signal to receivers in the immediate neighbourhood such that, provided the receivers are in a condition to accept the configuration signal, the receivers will set their circuit code to that provided in the configuration signal.

A further function of the transmitter radiates a full power test signal that can be checked at any receiver to determine that there is sufficient signal at such receivers for reliable transmission.

Figure 2:
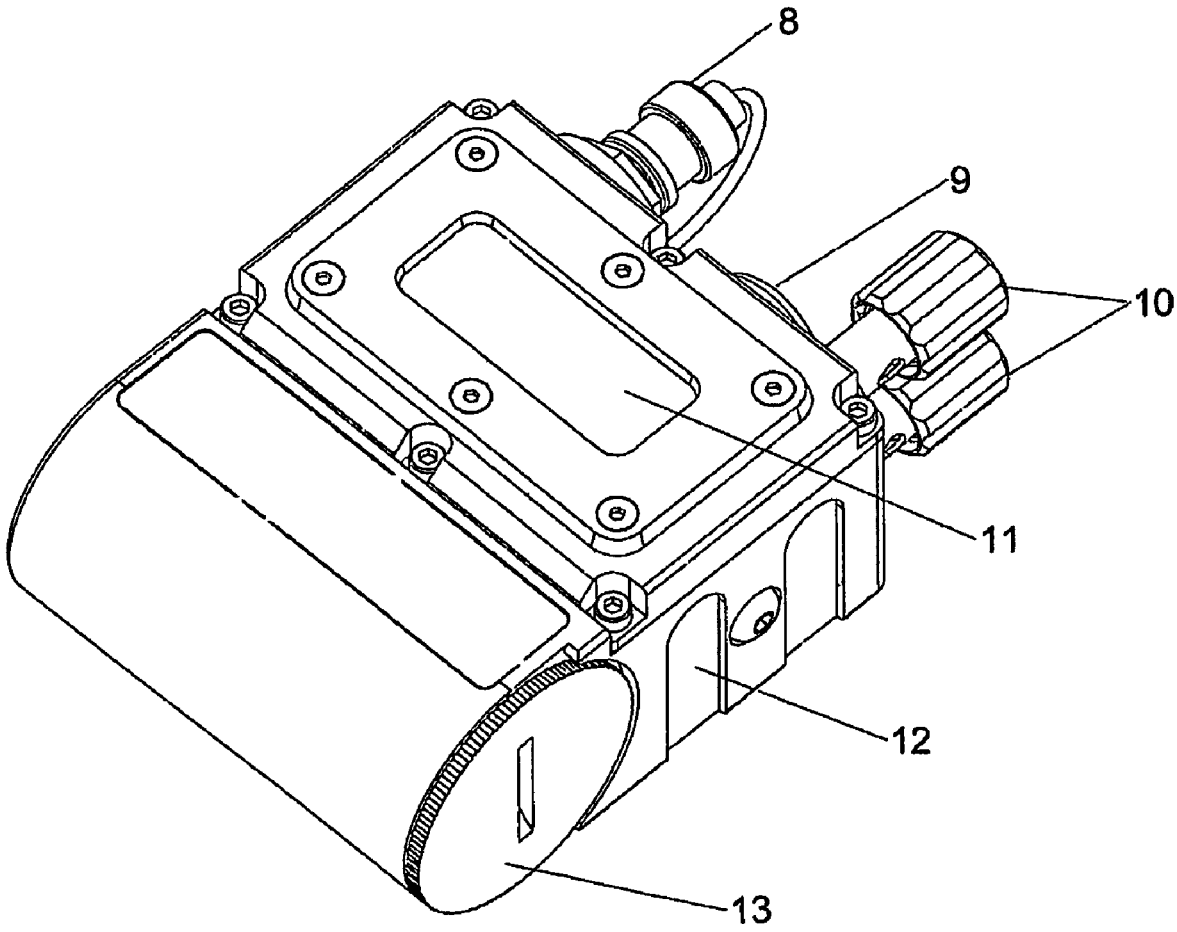
Figure 2A:
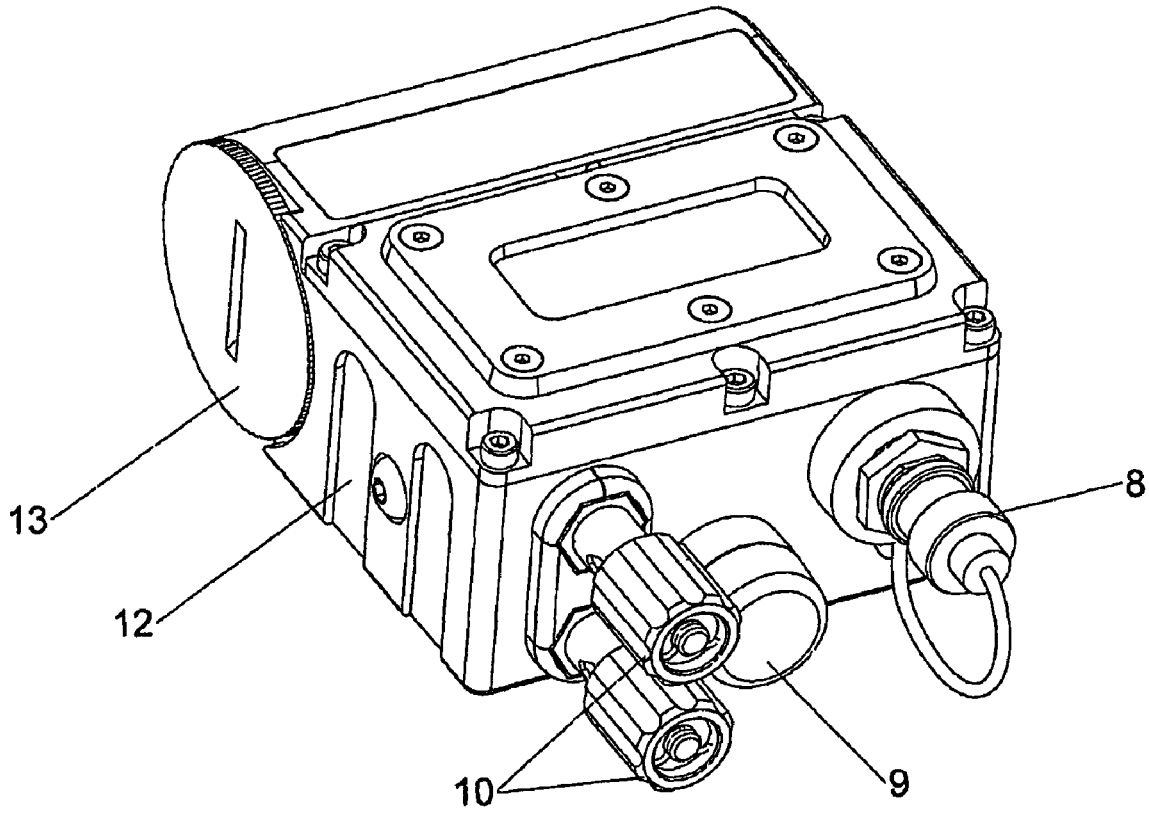

FIGS. 2 and 2A show a reusable receiver in front and rear views. The housing 12 is sealed to be waterproof to a depth of 20 meters and to withstand an altitude of 30,000 ft. The receiver has volume of approximately 440 $cm^3$.

The receiver power is supplied by a single disposable D cell Alkaline battery, held within the battery compartment 13.

The receiver has two electrical terminals 10 that provide connection of the firing voltage to electric detonators. The cable to the electric detonators can be up to 300 meters and make connection to up to six detonators.

The receiver has an antenna connector 8 to which maybe connected a quarter-wave or half-wave monopole or an extension cable to extend the antenna position for improved radio reception.

Figure 5A:
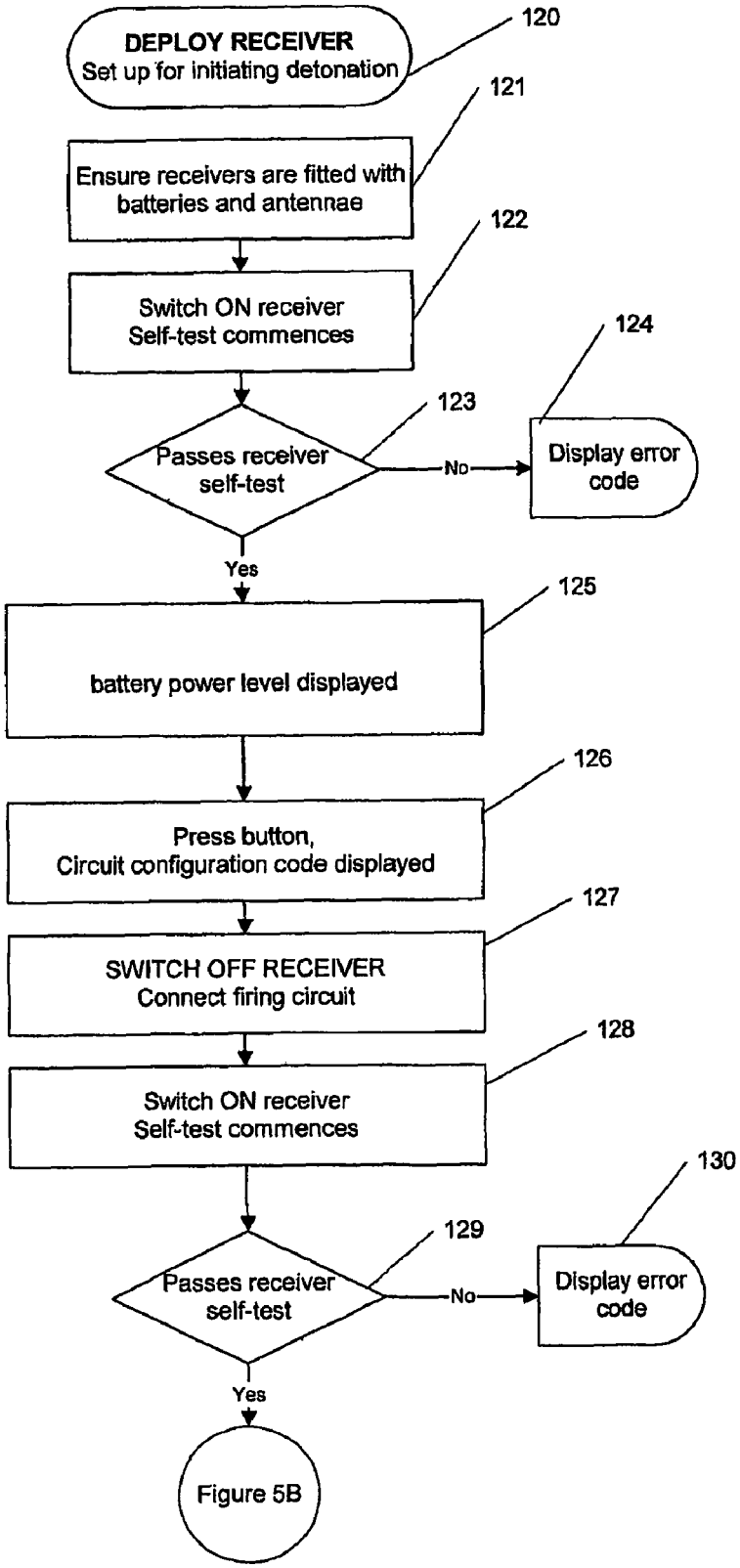
Figure 5B:
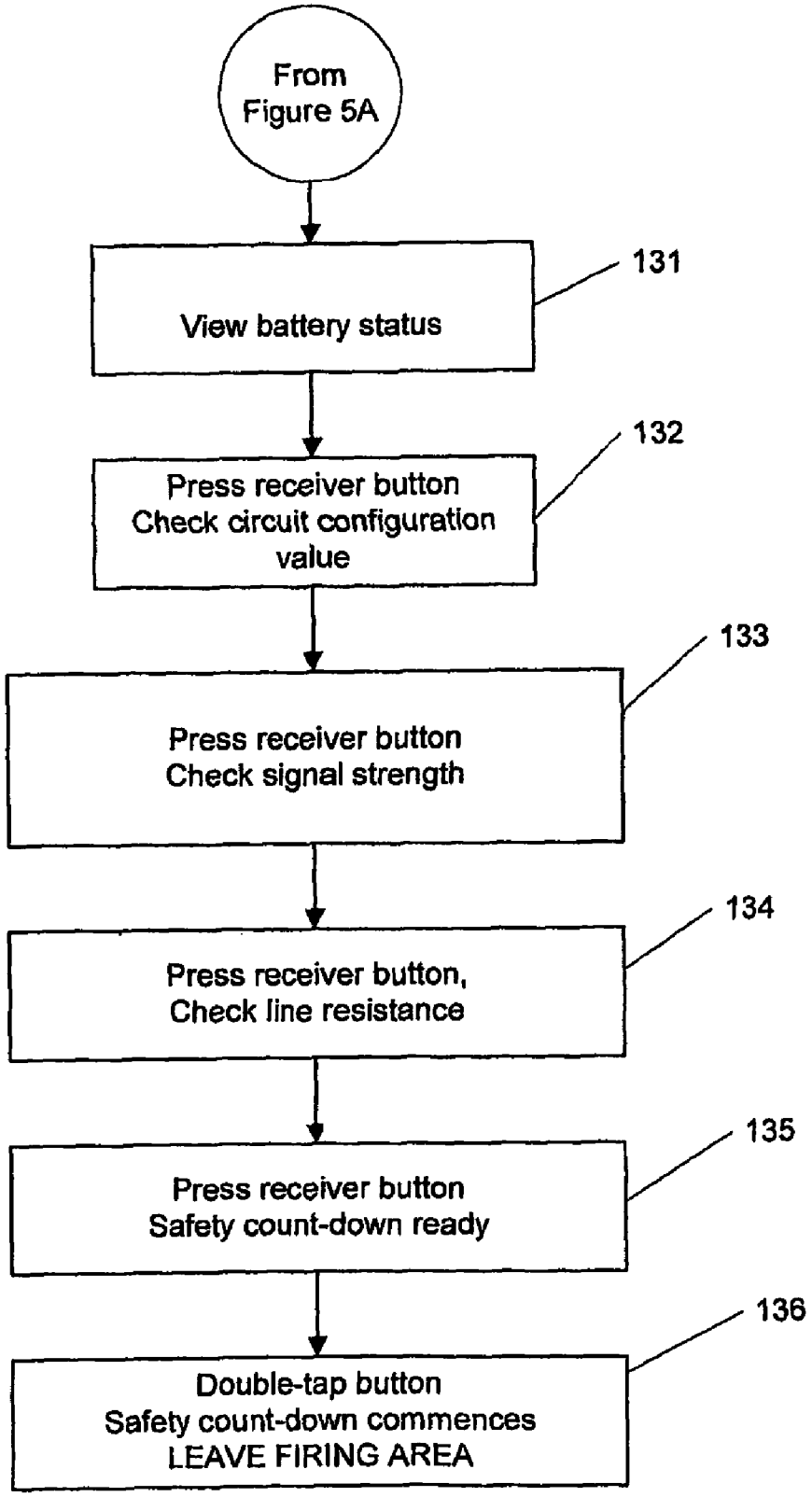

Press-button 9 switches on the receiver with a steady depression and also in conjunction with functions indicated on the display 11 by single presses or 'double' presses of the button carries out the operating functions of the receiver in FIGS. 4, 5A & 5B.

Figure 3:
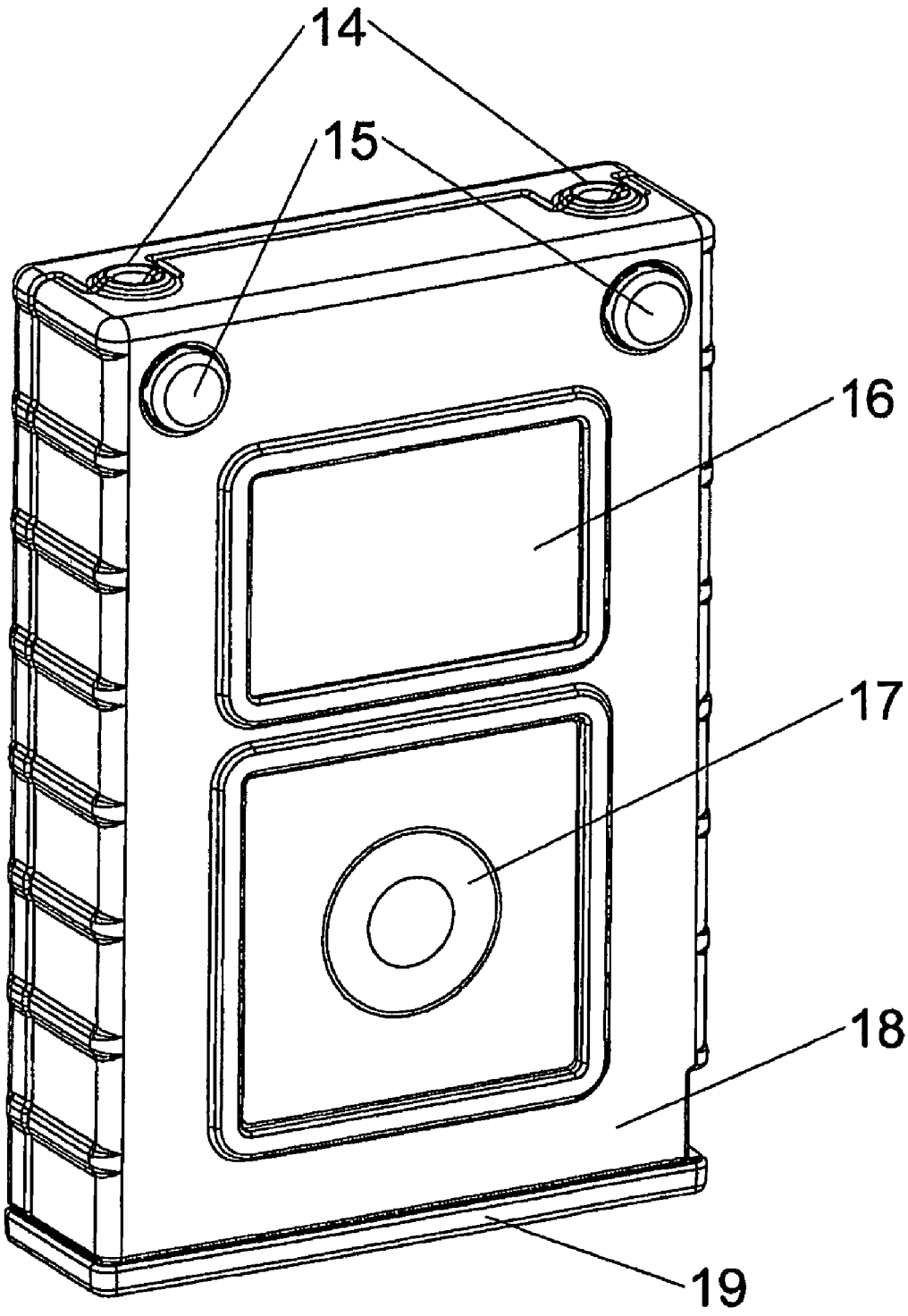

FIG. 3 shows an expendable/disposable receiver in front view. The housing 18 is sealed to be waterproof to a depth of 1 meter and to withstand an altitude of 30,000 ft. The receiver has volume of approximately 80 $cm^3$. The receiver has an antenna contained internally within the housing 18. The receiver power is supplied by a single disposable AA cell alkaline battery, held within the battery compartment 19.

The receiver has two electrical terminals 14 that provide connection of the firing voltage to electric detonators. The terminal buttons 15 are depressed and the cable inserted into the terminal holes 14. The cable to the single electric detonator can be up to 5 meters in length.

A press-button 17 switches on the receiver with a steady depression and also in conjunction with functions indicated on the display 16 by single presses or 'double' presses of the button carries out the operating functions of the receiver in FIGS. 4, 5A & 5B.

The disposable/expendable receivers are able to be-used in combat situations where the initiation of demolitions in which the operator does not return to the site of the demolition. In this situation the receiver unit will not be recovered and hence it is desirable that the receiver is 'expendable', i.e. destroyed in the demolition.

Such disposable/expendable receivers are of a much lower cost and as a consequence many of the superior specifications usually required, but not all, must be sacrificed. Namely the radio range may reduce 1 km in an urban environment, temperature range to −10° C. to +50° C., water depths are only to 1 meter, firing cable lengths reduce to 20 meters. The expendable receiver still retains the ability to be carried to an altitude of 30,000 ft, the same easy to use operator functionality, disposable batteries, and the full safety features.

The remote initiator is designed as a high performance remote initiation system designed to command detonates explosives by radio signals. Each Receiver is designed to detonate a single circuit. The circuit consists typically of one Class 1 detonator and shot firing cable of up to 450 meters.

One transmitter can control up to one hundred receivers and the equipment is designed so that Receivers will operate simultaneously or individually, as commanded, within closely controlled limits. Different system configurations may be assembled according to operational need with the receivers being associated with a particular transmitter by means of both frequency and group code. Common configurations are one transmitter and two, five or ten receivers.

Transmitter and reusable receiver housings are of machined aluminum alloy and epoxy powder coated. In use the remote initiator is normally supplied in sets of 1 transmitter and 2 receivers, which together with optional accessories are contained in an injection molded ABS/Polycarbonate transit case. Transmitters and receivers have individual webbing pouches designed for belt attachment and include a quarter wave antenna, and operator instruction summary card.

The transmitter includes built-in test circuits to confirm safety, reliability, and shut down in safe, state if a fault detected. Simultaneous two button operation is required for firing. The firing button mounted on the top face of the transmitter, orthogonal to the keypad to minimize probability of accidental firing if dropped. Sensitive data held in memory is protected by CRC checksum.

The receiver includes built-in test circuits to confirm safety, reliability, and shut down in safe state if fault detected. A failure results in unit shutdown to a safe state and indication of fault type via LCD indicators. The receiver also has dual arming-delay safety timers with 'time remaining' display, software checks to back up hardware safety breaks. Also the receiver short circuits the firing capacitor until authentication of firing command. Sensitive data held in memory is protected by CRC checksum. There is duplication of critical components so that no single component failure is capable of causing unintended detonation.

Generally the firing code is a binary bit stream, which is base-band, modulated using Manchester encoding, and then transmitted using direct FSK modulation of the RF carrier. Integrity of the transmission comes from the length of the code and the high level of error detection built into the coding scheme. A number of different codes or identifiers are embedded in the transmission which must match keys with the receiver before a firing event is initiated.

Transmitter Controls: Mounted on the top left surface of the transmitter is the ON/OFF switch. To switch the Transmitter ON or OFF, lift and rotate the switch. When switch is located in the ON position firing is possible, when switch is located in the OFF position firing is not possible. The Fire button is mounted on the top right face of the transmitter orthogonal to the keypad. It is used in conjunction with Tx to send a fire command. Mounted on the front face of the transmitter is a 4 key tactile keypad. The functions are as follows:

Tx in conjunction with other keys is used to initiate the transmission of a fire command, receiver configuration or test. "↑" key increments a numeral, increments to an option or step through a menu. Menu key exits any current function and returns to the menu selection display immediately above related to the function being exited from. This key can be seen as an Escape key. The OK key accepts a selected numeral or option.

Transmitter Indicators: Mounted behind and central to the LCD are 2 green high efficiency LEDs. The use of the LEDs are directly linked to an option, with backlighting, that an operator may chose. The options available are:

0 Backlight on, LEDs disabled.

1 Backlight off, LEDs enabled. (Low intensity) Night Vision

2 Backlight on, LEDs enabled. (High intensity)

3 Backlight off, LEDs enabled. (High intensity)

These LEDs augment the LCD in order to distinguish the current operating mode of the transmitter at temperatures lower than −20° C. The LEDs can easily be disabled or enabled by the operator. The functions of the LEDs are:

Top LED The top LED typically follows key press behavior.

Bottom LED The bottom LED is directly related to the transmission of a fire command, or error state if continually flashing.

The transmitter incorporates a backlit 3½ digit LCD screen. The screen backlight will remain on for 15 seconds after the last key press.

Receiver Controls: Mounted on the top face of the receiver is an ON/OFF push button momentary switch. All receiver functions or mode sequences are controlled by means of the ON/OFF button. This switch is multi-functional. When held down for greater than 600 milliseconds the receiver will power off: Briefly holding the button down and releasing (single tap) will move the receiver into the next mode sequence. When in 'ready to count' mode a double tap will move the receiver into the Safety Countdown display.

Receiver Indicators: Mounted behind and central to the LCD are 2 green high efficiency LEDs. The use of the LEDs are directly linked to an option with backlighting, that an operator may chose. The options available are:

0 Backlight on, LEDs disabled.

1 Backlight off, LEDs enabled: (Low intensity) Night Vision

2 Backlight on, LEDs enabled. (High intensity)

3 Backlight off, LEDs enabled. (High intensity)

These LEDs augment the LCD in order to distinguish the current operating mode of the receiver at temperatures lower than −20° C. The LEDs can easily be disabled or enable by the operator. The functions of the LEDs are:

Top LED The top LED typically follows key press behavior.

Bottom LED The bottom LED is directly related to the transmission of a fire command, or error state if continually flashing.

The receiver incorporates a backlit 3½ digit LCD screen. If set to option 0 or 2 the screen backlight will remain on for 15 seconds after the last key press.

Transmitter and receiver both employ dual independent processors. Each processor is of a different type. Code for each processor is written by independent software teams to avoid common coding errors: Software developed in accordance with ISO 9001 and maintained in a controlled documented environment. The software is written following strict coding practices including:

Use of pseudo 'high level' code (PDL) to define code structure before converting to assembler language.

Only one entry and exit point in sub-programs

Strict control on use of registers to minimize accidental over-writes.

Use of a separate register bank for interrupt handling.

Use of interrupts restricted to timing and data reception.

Avoidance of the use of dynamic memory management.

Avoidance of the use of floating point arithmetic

Protection of sensitive data by CRC checksums.

Verification of the software is by formal software analysis process including:

Safety commentary

Software Fault Tree Analysis (FTA)

Validation and Verification (V&V) reports

The remote initiator is designed to command detonate explosives either by radio signals or time. The remote initiator has the flexibility to be employed as an offensive or defensive initiation system for special operations and as a conventional demolition or E.O.D. initiation system. The remote initiator operates by using a UHF radio link or timed initiation thereby overcoming the disadvantages associated with wire based systems. As mentioned previously the remote initiator comprises of one transmitter and either two, five or ten receivers, depending on operator requirements. Each receiver initiates one circuit, commonly referred to as a line. Each line has the capacity to fire a circuit with a total resistance no greater than 25 ohms. The remote initiator typical operating range, in RIFs mode, in an urban environment is approximately 3 kms. In open terrain 3-5 kms could be expected, whilst under line of sight conditions, ranges of 10-25 kms are possible.

Design Safety Features

The remote initiator utilizes UHF radio signals to send firing commands from the transmitter to the receiver. Each system operates on a specific frequency. The transmitter can only activate receivers belonging to the same group because, within the software, each system is allocated a unique three digit code. This code is referred to as the Group Code. The Group Code is marked clearly on the exterior all transmitters and receivers.

The situation could occur where two systems are deployed operating on the same frequency. Interference will occur if two transmitters are operated at exactly the same time (unlikely given the short transmission duration) within the signal reception area. This will not result in the unintentional firing of a circuit because of the unique code associated with each system. Instead those receivers within the signal reception area will ignore the firing commands. This effect is known as "blocking". The dual processors incorporated in both the transmitter and receiver increase code transmission reliability of the transmitter and reliability of the decoding function of the receiver. In TIFs mode both processors run independent clocks, times must synchronize before initiation can take place.

A comprehensive error checking system is employed on the radio transmission, involving a data comparison and validation process. This ensures the integrity of all detonation commands and hence a high safety standard.

The capacitor discharge system used in the firing circuit prevents damage to cables or receivers if there is an accidental short circuit. The receiver incorporates an ON/OFF push button momentary switch. The ON/OFF switch controls all receiver functions. When the ON/OFF switch is held down for more than 1 second the receiver will power down. Briefly holding down the ON/OFF switch will allow the operator to move to the next mode in the program sequence. A safety delay of 2 or 5 minute duration is incorporated within the receiver prior to arming and is displayed as a countdown from 290 seconds to 0 seconds.

During the countdown period, cycling through the programme or switching the receiver OFF will disarm the receiver. The transmitter incorporates a lift rotary ON/OFF switch in order to prevent inadvertent initiation of any circuits during the set up process. This ON/OFF switch effectively creates a safe environment for the operator in which to prepare the explosives.

The transmitter should only be turned ON when configuring the receiver and when initiating explosives. Two firing buttons are located on the transmitter on two different surfaces. A two handed key press is required to transmit the firing command.

Turning to FIGS. 4 to 6 which set out the operating process of the remote initiator. FIG. 4 relates to the configuration 100 of a receiver circuit code. Before the transmitter is turned on the transmitters and receivers are checked to see if they are fitted with batteries and antennas, 101. If okay then the transmitter is turned on and a self test is commenced, 102. The outcome of the self test, 103, displays an error code, 104, if the test fails or continues if the test is ok. Then the receiver is switched on and a self test is commenced, 105. The outcome of the self test, 106, displays an error code, 107, if the test fails or continues if the test is ok. If okay then pressing of the receiver button causes the current circuit configuration code to be displayed and the configuration letter flashes for 60 seconds while configurable, 108. Then the transmitter configuration function is selected, circuit configuration value selected and the USER/GROUP/CIRCUIT values transmitted, 109. The receiver displays the new circuit value, 110. The receiver is now configured for operations, the transmitter and receiver can be switched off until required, 111.

FIGS. 5A & 5B relates to the deploying of the receiving and setting up for initiating detonation, 120. The receiver is checked to ascertain if fitted with batteries and antenna, 121. If so, then it is switched on and the self test commences 122. The outcome of the self test, 123, displays an error code, 124, if the test fails or continues if the test is ok. If ok then the battery power level is caused to be displayed, 125. Then the circuit configuration code is caused to be displayed, 126. The receiver is then switched off and the firing circuit connected, 127. The receiver is switched back on and the self test commences 128. The outcome of the self test, 129, displays an error code, 130, if the test fails or continues if the test is ok. If ok (turn to figure 5B), then the receiver button is pressed to view the battery status, 131 followed by pressing the receiver button again to check the circuit configuration value, 132, followed by check the signal strength, 133, and the line resistance, 134. The receiver button is then pressed to 'Safety count-down' ready, 135. The receiver button is then double tapped to commence 'safety count-down', 136.

FIG. 6 relates to the firing of a circuit using the transmitter to initiate firing of the receiver, 140. The ON switch of the transmitter is lifted and rotated into the ON position, 141. Self testing of the transmitter commences 142. The outcome of the self test, 143, displays an error code, 144, if the test fails or continues if the test is ok. If ok then the transmitter is now in "address mode" and the "↑" key is used to set the $1^{st}$ circuit digit and OK pressed to confirm, 144. The "↑" key is then used to set the $2^{nd}$ circuit digit and the OK key pressed to confirm, 145. The send fire command is activated by holding the OK key and pressing the Tx key in order initiate firing and a FIRED status is displayed on the transmitter, 146.

Advantages a) Improved safety
b) Timed or Non Timed Initiation
c) Single or multi receiver operation
d) No single component failure can result in an unsafe condition and firing
e) Dual microprocessors
f) Sharing of common signalling code between transmitter and receiver(s)

Variations

Throughout the description of this specification, the word "comprise" and variations of that word such as "comprising" and "comprises", are not intended to exclude other additives, components, integers or steps.

It will of course be realized that while the foregoing has been given by way of illustrative example of this invention, all such and other and variations thereto as would be apparent to persons skilled in the art are deemed to fall within the broad scope and ambit of this invention as is herein defined in the appended claims.

The invention claimed is:

1. A remote initiator for the remote initiation of explosive charges, wherein the remote initiator includes:

(i) a transmitter having means for generating and transmitting a coded signal and input means for inputting operational commands into the transmitter for generating the coded signal, (ii) at least one receiver adapted to be connected with the explosive charges, the receiver having means for receiving the coded signal from the transmitter and input means for inputting operational commands into the receiver for generating an output signal for the remote initiation of explosive charges upon receipt of a valid transmitted coded signal, (iii) a power source for each of the transmitter and receiver, and (iv) dual processing means that are independent of each other are adapted to provide independent control of a firing circuit and adapted to synchronise with each processing means before initiation can occur so as to enhance safety and reliability of the transmitter and receiver and the initiation of the remote initiator.

2. The remote initiator as claimed in claim 1, wherein each processing means are of a different type relative to other.

3. The remote initiator as claimed in claim 2, wherein each processing means is a computerised processing means.

4. The remote initiator as claimed in claim 2, wherein the processing means is a microprocessor.

5. The remote initiator as claimed in claim 2, wherein each processing means in has a clock wherein each clock is independent of the other and the times of each clock must be synchronized with each other before initiation of the remote initiator can occur.

6. The remote initiator as claimed in claim 1, wherein the transmitter includes the dual processing means.

7. The remote initiator as claimed in claim 1, wherein the receiver includes the dual processing means.

8. The remote initiator as claimed in claim 1, wherein both the transmitter and receiver include separate dual processing means.

9. The remote initiator as claimed in claim 4, wherein each microprocessor is a differing type relative to other to ensure no common failings in each processor.

10. The remote initiator as claimed in claim 9 wherein the software for each microprocessor is independently written.

11. The remote initiator as claimed in claim 1, wherein the transmitter and receivers share a common signal code, wherein the signal code includes:

(i) a USER code adapted to allow remote initiator to be initiated by the designated users, (ii) a GROUP code adapted to allow users of a group to use the initiator, and (iii) a CIRCUIT code adapted to allow for multiple and separate charges to fielded and initiated separately by the remote initiator.

12. The remote initiator as claimed in claim 1, wherein there is a plurality of receivers.

13. The remote initiator as claimed in claim 11, wherein the transmitter and receivers share a common signal code, wherein the signal code includes:

(i) a USER code adapted to allow remote initiator to be initiated by the designated users, (ii) a GROUP code adapted to allow users of a group to use the initiator, and (iii) a CIRCUIT code adapted to allow for multiple and separate charges to be fielded and initiated separately by the remote initiator.

14. The remote initiator as claimed in claim 1, wherein each of the transmitter and receiver have built in self tests adapted to be activated at switch on.

15. The remote initiator as claimed in claim 14, wherein both the transmitter and receiver are adapted to operate and withstand environmental extremes.

16. The remote initiator as claimed in claim 15, wherein the transmitter and receiver are adapted to operate in saltwater to depth of 20 meters, operate in temperature range of −40° C. and +60° C. and carriage in an unpressurised aircraft to 30,000 feet.

17. The remote initiator as claimed in claim 1, wherein the receiver includes a timer initiation function adapted to allow detonation after a settable elapsed time delay.

18. The remote initiator as claimed in claim 17, wherein the timer initiation function is adapted to be overridden so as to still allow for remote firing and detonation.

19. The remote initiator as claimed in claim 1, wherein the receiver is adapted to be reusable.

20. The remote initiator as claimed in claim 1, wherein the receiver is adapted to be expendable.

21. The remote initiator as claimed in claim 1, wherein the transmitter is adapted to activate a receiver with a line of sight transmission within 25 kms.

22. The remote initiator as claimed in claim 1, wherein the transmitter is adapted to activate a receiver in an urban environment within 3 kms.

23. The remote initiator as claimed in claim 1, wherein the transmitter is adapted to activate a receiver in open terrain within 3-5 kms.

24. The remote initiator as claimed in claim 1, wherein the power source is a battery or batteries.

25. The remote initiator as claimed in claim 10, wherein the transmitter includes control buttons that are adapted to permit simultaneous two button operation is required for firing of the remoter initiator.

26. The remote initiator as claimed in claim 10, wherein the software for each microprocessor has strict coding practices including:

(i) use of pseudo 'high level' code (PDL) to define code structure before converting to assembler language, (ii) only one entry and exit point in sub-programs, (iii) strict control on use of registers to minimise accidental over-writes, (iv) use of a separate register bank for interrupt handling, (v) use of interrupts restricted to timing and data reception, (vi) avoidance of the use of dynamic memory management, (vii) avoidance of the use of floating point arithmetic, and (viii) protection of sensitive data by CRC checksums.

27. The remote initiator as claimed in claim 1, wherein the remote initiator is adapted to be command detonation of explosives by either radio signals or time or both.

28. The remote initiator as claimed in claim 13, wherein the receiver is adapted to only respond to the common signal code received from the transmitter only if the transmitted common signal code matches all parts of the receivers internal code.

29. A remote initiator for the remote initiation of explosive charges, the remote initiator includes:

(i) a transmitter having means for generating and transmitting a coded signal and input means for inputting operational commands into the transmitter for generating the coded signal, (ii) at least one receiver adapted to be connected with the explosive charges, the receiver having means for receiving the coded signal from the transmitter and input means for inputting operational commands into the receiver for generating an output signal for the remote initiation of explosive charges upon receipt of a valid transmitted coded signal in communication with the receiver, (iii) a power source for each of the transmitter and receiver, and (iv) dual processing means that are independent of each other are adapted to provide independent control of a firing circuit and adapted to synchronise with each processing means before initiation can occur so as to enhance safety and reliability of the transmitter and receiver and the initiation of the remote initiator, wherein the transmitter and receiver share and store a common signalling code that binds both the transmitter and receiver to a group and the receiver will only respond to a transmitted coded signal that matches all parts of the common signalling code stored in the receiver.

30. The remote initiator as claimed in claim 29, wherein there is a plurality of receivers, each adapted to receive and process a coded signal from the transmitter and initiate an output signal for the remote initiation of explosive charges in communication with the receivers.

31. The remote initiator as claimed in claim 30, wherein the common signalling includes:

(i) a USER code adapted to allow remote initiator to be initiated by designated users, (ii) a GROUP code adapted to allow users of a group to use the initiator, and (iii) a CIRCUIT code adapted to allow for multiple and separate charges to be fielded and initiated separately by the remote initiator.

32. The remote initiator as claimed in claim 31, wherein each processing means are of a different type relative to other.

33. The remote initiator as claimed in claim 32, wherein each processing means is a omputerised processing means.

34. The remote initiator as claimed in claim 32, wherein the processing means is a microprocessor.

35. The remote initiator as claimed in claim 32, wherein each processing means in has a clock wherein the times of each clock must be synchronized with each other before initiation of the remote initiator can occur.

36. The remote initiator as claimed in claim 31, wherein the transmitter includes the dual processing means.

37. The remote initiator as claimed in claim 31, wherein the receiver includes the dual processing means.

38. The remote initiator as claimed in claim 31, wherein both the transmitter and receiver include separate dual processing means.

39. The remote initiator as claimed in claim 34, wherein each microprocessor is a differing type relative to other to ensure no common failings in each processor.

40. The remote initiator as claimed in claim 39 wherein the software for each microprocessor is independently written.

41. A remote initiating system for the remote initiation of explosive charges, the remote initiating system includes a remote initiator including:

(i) a transmitter having means for generating and transmitting a coded signal and input means for inputting operational commands into the transmitter for generating the coded signal, (ii) at least one receiver adapted to be connected with the explosive charges, the receiver having means for receiving the coded signal from the transmitter and input means for inputting operational commands into the receiver for generating an output signal for the remote initiation of explosive charges upon receipt of a valid transmitted coded signal in communication with the receiver, (iii) a power source for each of the transmitter and receiver, and (iv) dual processing means that are independent of each other are adapted to provide independent control of a firing circuit and adapted to synchronise with each processing means before initiation can occur so as to enhance safety and reliability of the transmitter and receiver and the initiation of the remote initiator, wherein the transmitter and receiver share and store a common signalling code that binds both the transmitter and receiver to a group and the receiver will only respond to a transmitted coded signal that matches all parts of the common signalling code stored in the receiver.

* * * * *

UNITED STATES PATENT AND TRADEMARK OFFICE

CERTIFICATE OF CORRECTION

PATENT NO. : 8,134,822 B2
APPLICATION NO. : 12/440313
DATED : March 13, 2012
INVENTOR(S) : Roger Ballantine et al.

It is certified that error appears in the above-identified patent and that said Letters Patent is hereby corrected as shown below:

Column 12, Line 34, Claim 2:

After "relative to" insert -- the --.

Column 12, Line 40, Claim 5:

After "processing means" delete "in".

Column 12, Line 52, Claim 9:

After "relative to" insert -- the --.

Column 12, Line 64, Claim 11:

After "separate charges to" insert -- be --.

Column 13, Line 45, Claim 25:

After "two button operation" delete "is required".

Column 14, Line 44, Claim 32:

After "relative to" insert -- the --.

Column 14, Line 47, Claim 33:

After "processing means is a "delete "omputerised" and insert -- computerised --.

Column 14, Line 52, Claim 35:

After "processing means" delete "in".

Signed and Sealed this
Fourteenth Day of August, 2012

David J. Kappos

David J. Kappos
*Director of the United States Patent and Trademark Office*

Column 14, Line 64, Claim 39:

After “relative to” insert -- the --.